US006682034B1

(12) United States Patent
Vial

(10) Patent No.: US 6,682,034 B1
(45) Date of Patent: Jan. 27, 2004

(54) REMOVABLE FOODSTUFF CONTAINER HOLDER

(75) Inventor: Jacques Antoine Vial, Velars (FR)

(73) Assignee: Amora Maille, Dijon (FR)

( * ) Notice: Subject to any disclaimer, the term of this patent is extended or adjusted under 35 U.S.C. 154(b) by 77 days.

(21) Appl. No.: 09/699,126

(22) Filed: Oct. 27, 2000

(30) Foreign Application Priority Data

Apr. 7, 2000 (FR) ..... 00 04493

(51) Int. Cl.[7] ..... A47B 96/06
(52) U.S. Cl. ..... 248/231.81; 248/311.2
(58) Field of Search ..... 248/231.81, 311.2, 248/312.1, 316.7, 309.1, 346.03, 346.11, 230.1, 230.5, 230.7, 316.6, 302; 220/23.4, 23.83, 575; 206/549

(56) References Cited

U.S. PATENT DOCUMENTS 2,235,986 A * 3/1941 Ellingson ..... 248/231.8
2,719,414 A * 10/1955 Davis ..... 248/302
2,803,120 A 8/1957 Wuerfel
3,533,590 A * 10/1970 Swire ..... 248/311.2
D281,565 S * 12/1985 Stourton et al. ..... D7/39
4,961,555 A 10/1990 Egan
4,989,742 A 2/1991 Powell
5,188,327 A * 2/1993 White ..... 248/231.8
5,695,162 A * 12/1997 DiCastro ..... 248/231.81
D449,206 S * 10/2001 DuBow ..... D7/620

FOREIGN PATENT DOCUMENTS

DE 8516315 8/1985
DE 8813769 12/1988
JP 6-22838 * 6/1994

* cited by examiner

*Primary Examiner*—Ramon O. Ramirez
*Assistant Examiner*—Tan Le
(74) *Attorney, Agent, or Firm*—John P. White; Cooper & Dunham LLP

(57) ABSTRACT

Removable, clip-on meal assistance system for a food holder (2), such as a tray or plate, for foodstuffs is provided. The system includes at least one container (3) of foodstuffs to accompany a main dish and an accessory (4) formed from a gripper (11) and means (12) for receiving the container(s). The gripper is able to be more or less elastically deformed to permit an accessory to be held on the support by gripping it. Accessory for the system and foodstuff container supported by the accessory also may be provided.

15 Claims, 3 Drawing Sheets

REMOVABLE FOODSTUFF CONTAINER HOLDER

BACKGROUND OF THE INVENTION

The present invention concerns the general technical subject of clip-on meal assistance systems for foodstuffs that are designed to be held by clipping onto a support.

More particularly, the present invention concerns a meal assistance system that includes an accessory designed to be clipped on to a foodstuff holder, for example the edge of a plate or tray, that makes it possible to hold containers for solid, liquid or pasty foodstuffs, for example cups holding a sauce or gravy.

The present invention also concerns each element of the system, directly and separately, that is, the accessory and the container.

Commonly found removable clip-on accessories for foodstuffs, which are designed to be held by clipping on to a support, are exclusively designed to momentarily hold a glass against a plate to free one of the user's hands. These known accessories are formed from a gripper and means for receiving at least one glass, the gripper and the receiving means protruding from an intermediate area, the gripper having an upper jaw and a lower jaw that include one longitudinal arm and two longitudinal arms, respectively, designed to extend on either side of the support by being deformed in an essentially elastic manner to enable the accessory to be held by gripping onto the support.

Such accessories are frequently used at cocktail parties or picnics since the user can then keep together a plate with the glass containing a drink. Only one of the user's hands is then required to hold the plate and glass, leaving one hand still.

However, even though such commonly found accessories are generally satisfactory, they can not be clipped onto supports of different thicknesses, which limits their use. Moreover, if the user attempts to clip an accessory to a support whose thickness does not correspond to the accessory, the stability of the accessory is diminished, requiring the user to watch to make sure that the accessory does not come loose from the plate and flip over.

To remedy these disadvantages, a first solution consists of having self-adhesive pads on the ends of the arms of the upper and lower jaws. However, the disadvantage of this solution is that it is cumbersome, not very practical and not very aesthetic. Indeed, attaching the accessory to the edge of the plate is not very convenient, and it is not easy to remove the accessory when the user no longer has need of it.

Finally, in general, the accessories mentioned above are designed for and meant exclusively to provide passive support for a glass in order to free up one hand. Thus, they were not designed to adapt to other functions that might introduce other diverse mechanical stresses requiring improved stability.

In particular, the development of the fast food industry in all its forms has produced new and constant needs for systems or accessories that can facilitate having of a meal, while still being easy to use.

For example, currently accompanying foodstuffs for the main dish, such as sauce or gravy, are served in the fast food industry simply by depositing a dose of the sauce or gravy directly in the plate in the middle of or to the side of the main dish, using a sauce or gravy distributor. In some cases, the user can use a separate capped cup containing the sauce or gravy and can pour its contents onto the plate, or more unusual, can dip the food directly into the container if it is large enough.

Such systems prove to be not very practical and often involve the random mixing of the main dish with the sauce or gravy, which can be perceived negatively by the user. In the case of a separate cup, the user must have a table or equivalent support because the cup usually must be held in one hand if the food is going to be inserted therein.

SUMMARY OF THE INVENTION

Consequently the objects of the invention seek to remedy the various disadvantages listed above, and to propose a new removable clip-on meal assistance system on a food holder that can facilitate having meals.

Consequently the objects of the invention deal with remedying the various disadvantages listed above, and to propose a new removable clip-on meal assistance system for foodstuffs that has improved stability after it is clipped on and during use.

Another object of the invention is to propose a new clip-on accessory that is inexpensive to manufacture, that has increased rigidity and is ergonomic.

Another object of the invention is to propose a new clip-on accessory that has numerous contact surfaces with the support after being clipped on.

Yet another object of the invention consists of proposing a new clip-on accessory designed to receive a container of a specific shape.

The objects assigned to the invention are achieved by a removable clip-on meal assistance system on a food holder, such as a tray or plate for example, characterized in that it has at least one container of foodstuffs to accompany a main dish and an accessory formed from a gripper and means for receiving the container(s), said gripper being able to be more or less elastically deformed to permit the accessory to be held on the support by gripping it.

Another object of the invention consists of proposing a container for foodstuffs designed to be supported by the receiving means of the accessory of the new meal assistance system. Advantageously, the shape of the container is adapted specifically to the receiving means of the accessory defined above.

The present invention also seeks to propose a new element formed by the attachment or clip-on accessory defined above.

BRIEF DESCRIPTION OF THE DRAWINGS

The objects assigned to the invention will be understood in more detail after reading the attached description as well as the drawings appended thereto, which description and drawings are provided purely for the non-limiting purposes of explanation, in which.

DETAILED DESCRIPTION

Figure 1:
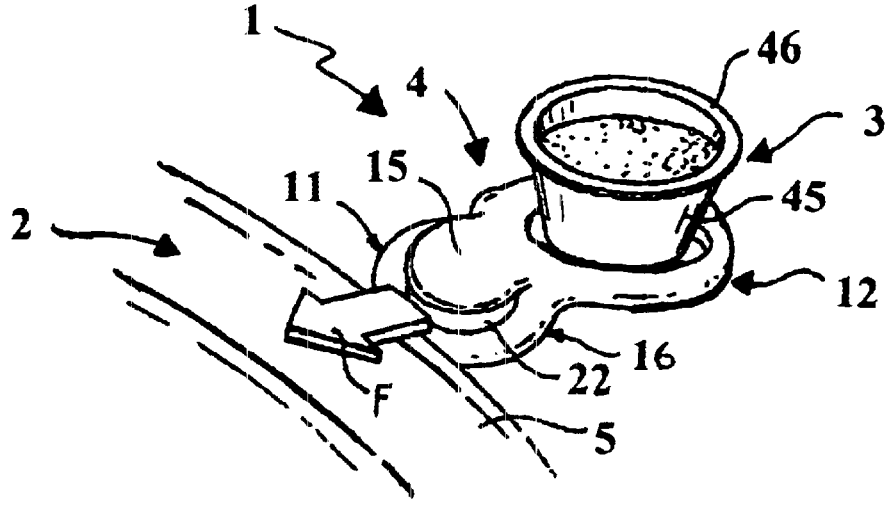
FIG. 1 shows a perspective view of a clip-on system according to the invention, which is in the process of being placed on the edge of a plate, the container for foodstuffs also in the process of being positioned in the accessory.
Figure 2:
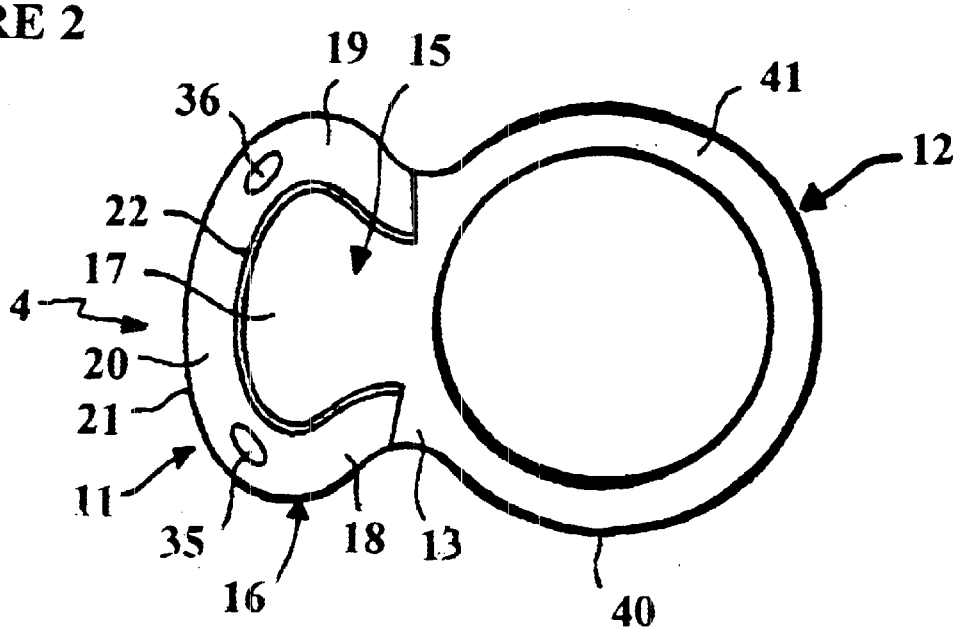
FIGS. 2 to 5 are top, side, longitudinal cross-section and bottom views, respectively, of the accessory according to the invention, in a first form of embodiment.
Figure 3:
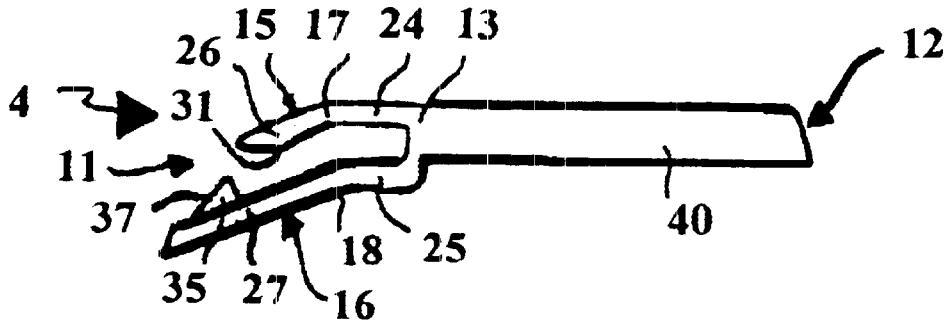
Figure 4:
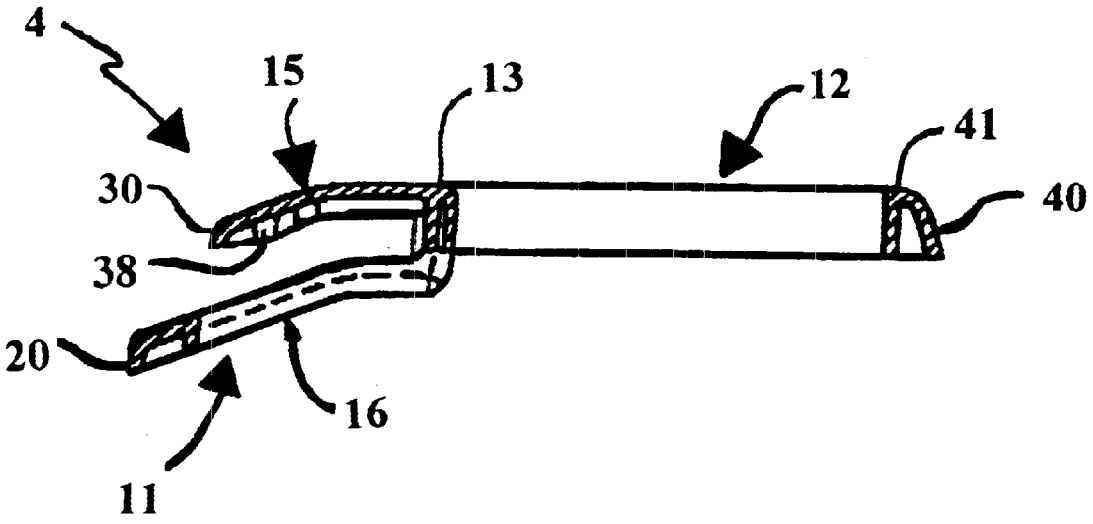
Figure 5:
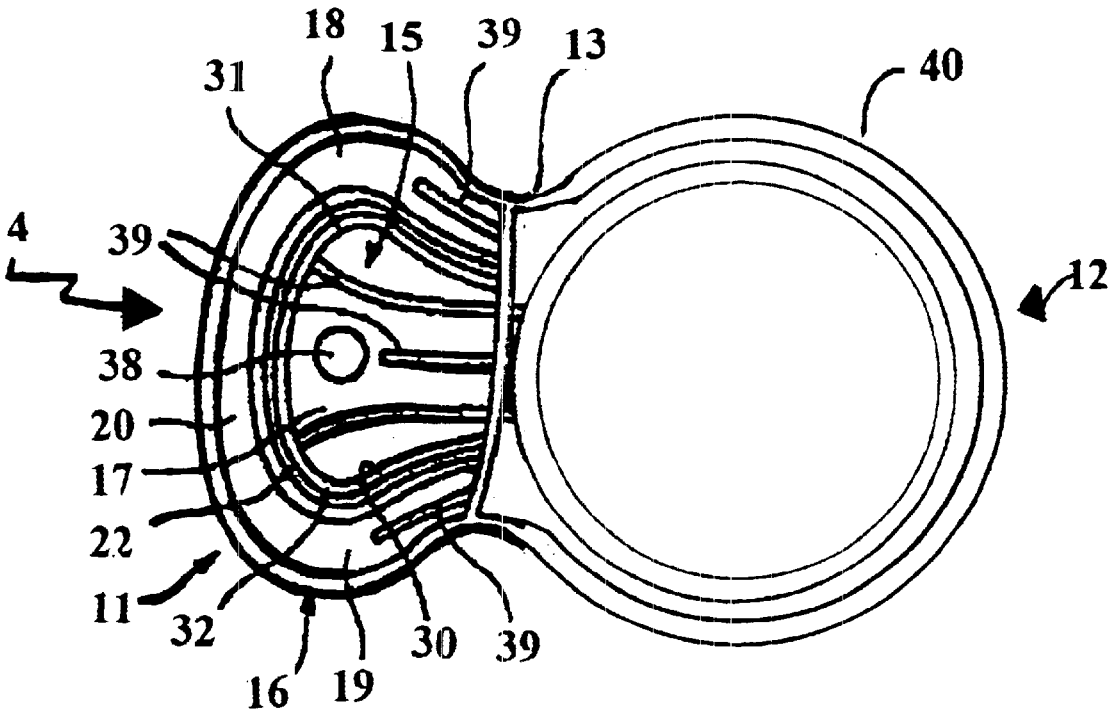

FIG. 1 illustrates a removable clip-on meal assistance system 1 for foodstuffs, which is designed to be held by gripping on a support 2, and in which a foodstuffs container 3 is designed to be housed.

The meal assistance system 1 according to the present invention includes an accessory 4, which is designed to be inserted onto the edge 5 of the support 2, such as a plate, in the direction of the arrow F, and also includes the container 3 which is designed to be inserted into the accessory 4.

In the context of the invention, meal is understood as being any consumption of food without restriction, for example during a snack, a cocktail party, a luncheon, a picnic, an afternoon tea or a dinner. Also in the context of the invention, support is understood to mean a tray, a plate or any element that enables a main dish to be supported.

The accessory 4 has a gripper 11 and receiving means 12. The gripper 11 is designed to be placed parallel to itself on the edge 5 of the plate 2, and the receiving means 12 are designed to house the container 3 such as a cup for sauce or gravy that is placed in these means from above.

As shown more particularly in FIGS. 2 to 5, the gripper 11 and the receiving means 12 protrude from an intermediate area 13. The gripper 11 has an upper jaw 15 and a lower jaw 16, which include one longitudinal arm 17 and two longitudinal arms 18 and 19, respectively. These arms are designed to extend on either side of the support 2 by being deformed in an essentially elastic manner to enable the accessory 4 to be held by gripping onto this support.

The arm 17 of the upper jaw 15 and the two arms 18 and 19 of the lower jaw 16 are described as longitudinal in that they extend parallel to the direction of insertion of the accessory 4 onto the support 2, that is, parallel to the arrow F in FIG. 1.

According to the present invention, the two longitudinal arms 18 and 19 of the lower jaw 16 are mutually connected by a transverse arm 20 to form a continuous leg 21, the intermediate area 13 and the continuous leg delimiting an opening 22.

The transverse arm 20 of the lower jaw 16 extends essentially perpendicular to the longitudinal arms 18 and 19 of this jaw.

Preferably, the shape of the continuous leg 21 does not have a sharp angle, particularly where the transverse arm 20 connects to the longitudinal arms 18, 19, and it has a shape similar to that of a "horseshoe."

In a preferential embodiment, the arm 17 of the upper jaw 15 is included in the opening 22 delimited by the intermediate area 13 and the continuous leg 21. The arm 17 is situated essentially in line with the opening 22. Also in a preferential embodiment, the shape of the arm 17 of the upper jaw 15 is essentially identical to that of the opening 22, in such a way that by superimposing the arm 17 of the upper jaw 15 and the continuous leg 21 of the lower jaw, an essentially solid surface is formed.

The arm 17 of the upper jaw 15 and the continuous leg 21 of the lower jaw 16 extend in a direction opposite to the direction of the receiving means 12. The arm 17 and the continuous leg 21 extend from a side of the intermediate area 13, while the receiving means 12 extend from the other side of this intermediate area 13. The area 13 thus forms a transverse flank from which the arms extend on two different levels. The intermediate area 13 thus forms an end stop when the accessory 4 is inserted onto the edge 5 of the support 2.

The accessory 4 according to the present invention is made from a single piece of any material according to any known process, and preferably by injection of a plastic material. The complementary shapes of the leg 21 of the lower jaw 16 and arm 17 of the upper jaw 15 facilitate injection in that it is not necessary to use a mold having a slide or a core.

The arm 17 and the continuous leg 21 each has a first section 24, 25 that protrudes from the transverse flank 13. These two first sections 24 and 25 define two extension planes that are essentially parallel and are mutually separated by a value at least equal to the thickness of the edge 5 of the support 2. Preferably, the separation between the first two sections 24 and 25 is essentially equal to the value of the thickness of this edge.

The first two sections 24 and 25 are extended respectively by the second sections 26 and 27 each of which forms an angle with the planes of extension. The second two sections 26 and 27 are also essentially parallel and extend downward.

The second section 26 of the arm 17 of the upper jaw 15 has a rabbet 30 which is turned toward the continuous leg 21 of the lower jaw 16, and which defines at least two bearing points 31 and 32 on the support 2 when the accessory 4 is clipped on to this support, the arm 17 of the upper jaw 15 and the continuous leg 21 of the lower jaw 16 then separating elastically to firmly grip the support.

In an advantageous embodiment, the two bearing points 31 and 32 are situated on either side of the arm 17 of the upper jaw 15. In one preferential variation, the portion of the rabbet 30 situated between the two bearing points 31 and 32 forms a continuous weight-bearing line on the support 2. This weight-bearing line is large in size compared to the general dimensions of the accessory, in such a way that the stability of the accessory 4 on the support 2 is very good.

The continuous leg 21 of the lower jaw 16 has at least two teeth 35 and 36 that protrude in the direction of the arm 17 of the upper jaw 15.

The shape of the teeth 35 and 36 is such that the upper extremities of these teeth define two essentially punctiform points of support designed to provide an elastic-bearing surface on the support 2.

The two teeth 35 and 36 are, for example, broad at the base and convergent toward their upper end. Thus they have, respectively, an inclined ramp 37 that forms an angle with the longitudinal direction of the accessory 1, for example this angle being approximately equal to 45°. When the accessory 4 is inserted onto the support 2, the ramps 37 facilitate the sliding of the support into the jaws and the teeth 35, 36 amplify the elastic deformation of the upper jaw 15 and lower jaw 16, in such a way that the edge 5 of the support 2 is firmly gripped. Moreover, the continuous form of the lower jaw makes the clip-on stable, and thus the accessory is not easily destabilized when the user moves about holding the support fitted with the accessory in one hand.

In addition, the elasticity of the arms of the upper and lower jaws allows the accessory 4 to be clipped on to supports 2 of different thicknesses.

As a variation, the upper jaw 15 has a spur 38 directed toward the lower jaw 16 and situated behind the continuous line defined by the rabbet 30. The spur 38 increases the bearing surface of the upper jaw 15 on the support 2 even more.

The arm 17 of the upper jaw 15 and the first section 25 of the continuous leg 21 of the lower jaw 16 have ribs 39 that make the gripper 11 rigid.

The receiving means 12 of the foodstuffs container 3 are composed of a ring 40 that extends parallel to the plane of extension defined by the first sections 24 and 25 of the arms.

The transverse section of the ring 40 is essentially U-shaped turned downward in such a way that this ring has a ring-shaped receiving face 41. The ring face 41 and the upper face of the upper jaw 15 are in the same plane.

The container 3 represented in FIG. 1 is preferably a cup, the side walls 45 of which are in the shape of a truncated cone opening out upward. At the top, the cup 3 has a collar 46 that extends radially.

As a variation, the cup 3 has interior partitions that define several compartments that can contain several types of foodstuffs.

When the cup 3 is placed in the accessory 4, the side walls 45 penetrate the ring 40 until the collar 46 stops on the upper support face 41 of this ring. Thus, when the cup 3 is positioned in the ring 40, most of the weight of this cup is situated below this ring. The cup 3 is therefore very stable and will not tend to slip out of the accessory 4.

This stability of the cup 3 is all the more important when the user wishes to dip the foodstuffs from the main dish into the cup to season said foodstuffs. During this seasoning operation, the assembly of the accessory 4 and the cup 3 undergo stresses that must be compensated for by the gripper.

Figure 6:
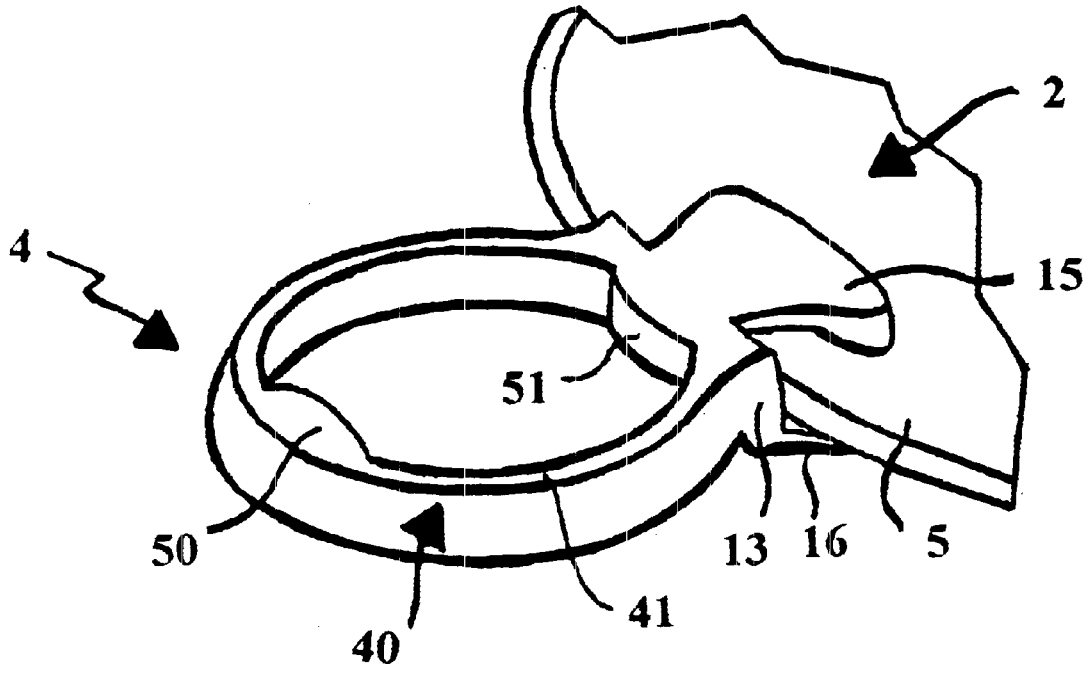
FIG. 6 is a perspective view of a second form of embodiment of an accessory according to the invention clipped onto the edge of a plate.
Figure 7:
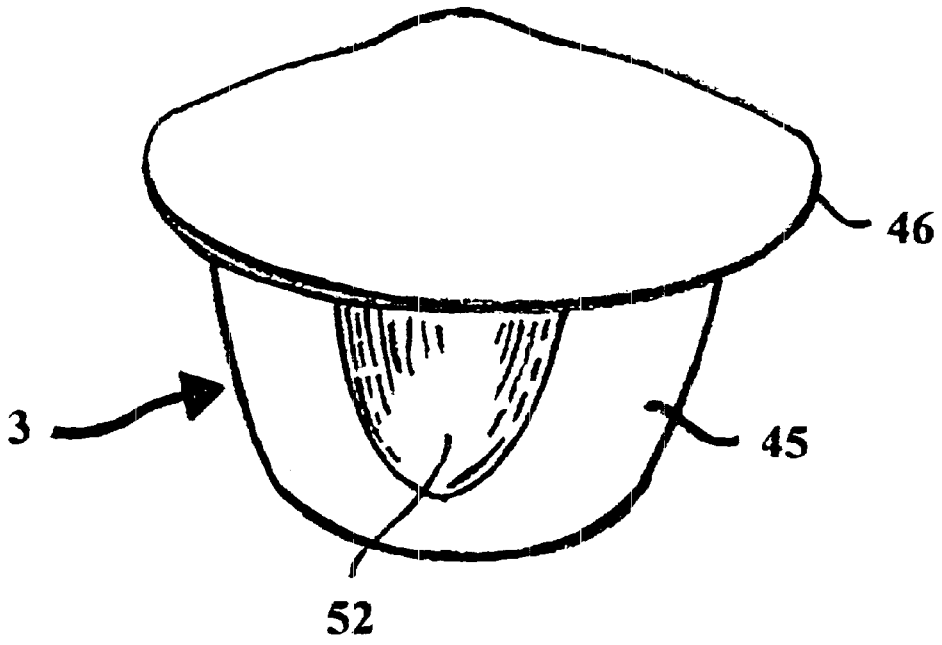
FIG. 7 is a perspective view of the container designed to fit inside the accessory of FIG. 6.

Moreover, in order to increase the stability of the cup 3 in the receiving means 12 of the accessory 4, the cup and the receiving means 12 can advantageously have means of complementary shape such as those represented in the second form of embodiment, in FIGS. 6 and 7

The parts comprising the accessory 4 and the cup 3 of the second form of embodiment and that are similar to those in the first form of embodiment will have identical reference numbers.

The ring 40 has at least one lobe, and preferably two lobes 50 and 51, which extend toward the center of the ring 40 and which cooperate with indentations 52 of a complementary shape that are made in the foodstuff container 3.

The lobes 50 and 51 preferably extend the full height of the ring and are diametrically opposed.

The shape of the indentations 52 is complementary to that of the lobes 50 and 51 in such a way that during insertion, the lobes 50 and 51 fit in the indentations 52. Thus, the exterior shape of the cup 3 is a shape specifically adapted to the interior shape of the ring, which prevents the cup from rotating inside the ring and from destabilizing. The stability of the cup 3 in the ring 40 is therefore all the greater. In addition, in the event the cup 3 does not have the indentations 52 that are complementary to the lobes 51, 52, the cup 3 can not be inserted in the ring 40.

The lobes 51 and 52 have a curved transverse cross-section, but can also be square or triangular shaped.

As a variation, the ring 40 has indentations and the cup has complementary lobes.

In yet another variation, the ring 40 with indentations or lobes can be integral with a gripper 11 having jaws that are formed in the usual way.

In another varation, the lobes 50 and 51 are developed in the vertical plane to constitute a clip with the indentations of the cup to positively secure the cup in the ring. When the user then wishes to remove the cup, he simply squeezes the side wall 45 of the cup to release the lobes.

Furthermore, it is obvious that the removable cup 3, once it is empty or practically empty, or when the user wishes to change condiments, can be replaced with a new cup. For example, when all or part of a sauce or gravy contained in the cup has been used, the cup can be refilled from a container holding said sauce or gravy.

What is claimed is:

1. Removable, clip-on meal assistance system for a food holder, comprising at least one container (3) of foodstuffs to accompany a main dish and an accessory (4) formed from a gripper (11) and means (12) for receiving the container(s), said gripper being able to be elastically deformed to permit the accessory (4) to be held on the support (2) by gripping it, wherein the gripper (11) has an upper jaw (15) and a lower jaw (16) provided with weight-bearing means (31, 32, 35, 36), respectively upper (31, 32) and lower (35, 36) designed to provide an elastic bearing surface on the support (2), the lower bearing surfaces (35, 36) being formed by at least two teeth (35, 36) that define toward their end two essentially punctiform points of support, the upper jaw (15) is provided with a rabbet (30) defining at least two bearing points (31, 32), and the gripper (11) and the receiving means (12) protrude from an intermediate area (13) of the accessory (4), the upper jaw (15) and the lower jaw (16) having one longitudinal arm (17) and two longitudinal arms (18, 19), respectively, designed to extend on either side of the support (2), said longitudinal arms (18, 19) of the lower jaw (16) being mutually connected by a transverse arm (20) to form a continuous leg (21), the intermediate area (13) and the continuous leg (21) delimiting an opening (22).

2. System according to claim 1, characterized in that the teeth (35, 36) protrude in the direction of the upper jaw (15) and are essentially conical in shape to define at least one inclined ramp (37) facilitating the insertion of the accessory (4) on to the support (2).

3. System according to claim 1, characterized in that the arm (17) of the upper jaw (15) is included in the opening (22) delimited by the intermediate area (13) and the continuous leg (21), this arm (17) being situated essentially in line with the opening (22).

4. System according to claim 3, characterized in that the arm (17) of the upper jaw (15) and the continuous leg (21) of the lower jaw (16) extend in a direction opposite the direction of the receiving means (12).

5. System according to any of claim 3, characterized in that the intermediate area (13) has a transverse flank designed to form an end stop for the support (2).

6. System according to claim 5, characterized in that the arm (17) and the continuous leg (21) each has a first section (24, 25) which extends from the transverse flank (13), in that the first two section (24, 25) define two essentially parallel planes of extension and are each extended by a second section (26, 27), and in that the second two sections (26, 27) each form an angle with the planes of extension.

7. System according to claim 6, characterized in that the first sections (24, 25) extend essentially parallel and are mutually separated by a value at least equal to the thickness of the edge of the support (2).

8. System according to claim 6, characterized in that the second section (26) of the arm (17) of the upper jaw (15) has a rabbet (30) which is turned toward the continuous leg (21) and which defines at least two bearing points (31, 32) on the support (2) when the accessory (4) is clipped on to the support, the arm (17) of the upper jaw (15) and the continuous leg (21) then separating elastically.

9. System according to any of claims 1, 2 or 3, characterized in that the receiving means (12) of at least one foodstuffs container (3) has a ring (40) that extends parallel to the planes of extension.

10. System according to claim 9, characterized in that the ring (40) has at least two lobes (50, 51) that extend toward the center of the ring (40) and which are designed to cooperate with indentations (52) of a complementary shape that are made in the foodstuff container (3).

11. Foodstuffs container designed to be supported by receiving means (12) of an accessory (4) of the system (1) according to claim 1.

12. Container according to claim 11, characterized in that it has at least one formation (52) with a shape complementary to at least one relief (50, 51) made in the receiving means (12).

13. Container according to claim 12, characterized in that said at least one formation (52) is an indentation and said at least one relief (50, 51) is a lobe.

14. Accessory designed to be used in a system (1) according to any of claims 1, 2, 3, 4, 12 or 13.

15. Removable, clip-on meal assistance system for a food holder, comprising at least one container (3) of foodstuffs to accompany a main dish and an accessory (4) formed from a gripper (11) and means (12) for receiving the container(s), said gripper being able to be elastically deformed to permit the accessory (4) to be held on the support (2) by gripping it, wherein the gripper (11) has an upper jaw (15) and a lower jaw (16) provided with upper weight-bearing means (31, 32) and lower weight-bearing means (35, 36), respectively, to provide an elastic bearing surface on the support (2), and the gripper (11) and the receiving means (12) protrude from an intermediate area (13) of the accessory (4), the upper jaw (15) and the lower jaw (16) having one longitudinal arm (17) and two longitudinal arms (18, 19), respectively, designed to extend on either side of the support (2), said longitudinal arms (18, 19) of the lower jaw (16) being mutually connected by a transverse arm (20) to form a continuous leg (21), the intermediate area (13) and the continuous leg. (21) delimiting an opening (22).

* * * * *